US006095030A

United States Patent [19]

Kawachi

[11] Patent Number: 6,095,030

[45] Date of Patent: Aug. 1, 2000

[54] SWASH PLATE VARIABLE DISPLACEMENT COMPRESSOR

[75] Inventor: Masaki Kawachi, Tochigi, Japan

[73] Assignee: Calsonic Corporation, Tokyo, Japan

[21] Appl. No.: 09/175,419

[22] Filed: Oct. 20, 1998

[30] Foreign Application Priority Data

Oct. 21, 1997 [JP] Japan ..... 9-288756

[51] Int. Cl.[7] ..... F01B 3/00

[52] U.S. Cl. ..... 92/12.2; 417/222.1

[58] Field of Search ..... 92/12.2; 91/505, 91/506; 417/222.1, 222.2, 269; 74/839, 60

[56] References Cited

U.S. PATENT DOCUMENTS

| | | | |
|---|---|---|---|
| 4,475,871 | 10/1984 | Roberts | 417/222 |
| 5,292,233 | 3/1994 | Takenaka et al. | 417/222.2 |
| 5,645,405 | 7/1997 | Ota et al. | 417/269 |
| 5,706,716 | 1/1998 | Umemura | 92/165 |
| 5,749,712 | 5/1998 | Umemura | 417/269 |

FOREIGN PATENT DOCUMENTS

| | | |
|---|---|---|
| 5-195949 | 8/1993 | Japan . |
| 6-101640 | 4/1994 | Japan . |
| 7-103138 | 4/1995 | Japan . |
| 8-61231 | 3/1996 | Japan . |

OTHER PUBLICATIONS

Patent Abstracts of Japan, vol. 097, No. 011, Nov. 28, 1997 & JP 09 175159 (Calsonic Corp), Jul. 8, 1997.

*Primary Examiner*—Edward K. Look
*Assistant Examiner*—Thomas E. Lazo
*Attorney, Agent, or Firm*—Foley & Lardner

[57] ABSTRACT

A swash plate type variable displacement compressor for refrigerant in a refrigeration cycle of an air conditioning system for an automotive vehicle. The compressor comprises a drive shaft around which a journal is movably disposed around so as to be rotatable with the drive shaft. The journal has a generally cylindrical boss section which has an external thread portion, and a flange section. A swash plate is provided for converting a rotational motion of the drive shaft into a linear motion of the pistons. The swash plate is fixedly mounted on the boss section of the journal and has an internal thread portion which is engaged with the external thread portion of the boss section. The swash plate includes a generally cylindrical thick central section having the internal thread portion, and a peripheral section integral with the central section and having an axial dimension smaller than the central section. A plurality of tool engaging grooves are formed at least in the central section and located on a first surface of the swash plate. The tool engaging grooves are located along a circumference concentric with a central bore of the central section. Additionally, a plurality of seat projections are formed on a second surface of the swash plate which second surface is opposite to the first surface, each seat projection projecting in a direction away from the second surface. The seat projections are located respectively corresponding to and at back sides of the tool engaging grooves. Each seat projection is to be in contact with the flange section of the journal.

5 Claims, 2 Drawing Sheets

SWASH PLATE VARIABLE DISPLACEMENT COMPRESSOR

BACKGROUND OF THE INVENTION

1. Field of the Invention

This invention relates to improvements in a swash plate type variable displacement compressor for refrigerant, disposed in a refrigeration cycle, for example, of an air conditioning system of an automotive vehicle.

2. Description of the Prior Art

Swash plate type variable displacement compressors have been well known and put into practical use, for example, in order to pressurize refrigerant in an air conditioning system of an automotive vehicle. A typical example of such a swash plate type variable displacement compressor is disclosed in Japanese Patent Provisional Publication No. 7-103138, in which a journal is movably mounted on a drive shaft so as to be rotatable with the drive shaft. A swash plate is fixedly mounted on the journal in such a manner as to convert a rotational movement of the drive shaft into a linear motion of pistons. The journal and the swash plate are formed or molded independent from each other from the viewpoint of facilitating machining process. Accordingly, the boss section of the journal is formed at its outer peripheral part with an external thread portion, while the central section of the swash plate is formed with a threaded bore (having an internal thread portion). The swash plate is threadedly disposed on the boss section of the journal in a manner that the external thread portion is in engagement with the internal thread portion. As a result, the swash plate is integrally mounted on the journal.

The central section of the swash plate is formed projecting axially and annularly in the opposite directions so as to make the central section thick for the following reasons: The central section formed with the threaded bore requires an axially extending section for providing the internal thread portion. The swash plate is required to be formed at its the central section on its one side surface with engaging sections for a tightening tool for the swash plate. Additionally, The swash plate is required to be formed on the other side surface thereof with seat projections which are to be brought into contact with the surface of a flange of the journal. The seat projections function to restrict a tightening action of the tightening tool. In this regard, the outer peripheral part of one end portion of the thick central section is formed polygonal (for example, hexagonal) so that the tightening tool is engagable with the end portion, while the other end portion of the thick central section is left projecting annularly to serve the seat projection.

As a result, the thickness or axial dimension of the central section of the swash plate is increased over that necessary for forming the internal thread portion. This increases the weight of the swash plate, which is contrary to the requirement of lightening the compressor in weight while being disadvantageous from the viewpoint of production cost.

BRIEF SUMMARY OF THE INVENTION

It is an object of the present invention to provide an improved swash plate type variable displacement compressor which can effectively overcome drawbacks encountered in conventional swash plate type variable displacement compressors.

Another object of the present invention is to provide an improved swash plate type variable displacement compressor which is lightened in weight and advantageous from the viewpoint of production cost.

A further object of the present invention is to provide an improved swash plate type variable displacement compressor which has a swash plate configured to be light in weight and easy in production.

A swash plate type variable displacement compressor according to the present invention comprises a drive shaft. A journal is movably disposed around the drive shaft so as to be rotatable with the drive shaft. The journal has a generally cylindrical boss section which has an external thread portion, and a flange section. Pistons are movably arranged around the journal. A swash plate is provided for converting a rotational motion of the drive shaft into a linear motion of the pistons. The swash plate is fixedly mounted on the boss section of the journal and has an internal thread portion which is engaged with the external thread portion of the boss section. The swash plate includes a generally cylindrical thick central section having the internal thread portion, and a peripheral section integral with the central section and having an axial dimension smaller than the central section. A plurality of tool engaging grooves are formed at least in the central section and located on a first surface of the swash plate. The tool engaging grooves are located along a circumference concentric with a central bore of the central section. Additionally, a plurality of seat projections are formed on a second surface of the swash plate which second surface is opposite to the first surface, each seat projection projecting in a direction away from the second surface. The seat projections are located respectively corresponding to and at back sides of the tool engaging grooves. Each seat projection is to be in contact with the flange section of the journal.

With the above-arranged compressor, the tool engaging grooves on one side surface and the seat projections on the other side surface in the swash plate can be easily formed respectively as depressions and projections by applying the fine blanking onto the thick central section. Additionally, each seat projection is formed just at the back side surface of the tool engaging groove simultaneously with depressed-formation of the corresponding tool engaging groove under the fine blanking, and therefore it is required to only protrude one end portion (on the side of the rear side surface) of the thick central section is necessary so that protruding the opposite end portion (on the side of the front side surface) is unnecessary. Consequently, the thick central section is only required to have a necessary minimum thickness (axial dimension) to ensure a dimension for forming the internal thread portion. As a result, the swash plate can be sharply lightened in weight thereby greatly contributing to making the compressor light in weight. This is very advantageous from the viewpoint of production cost upon combination of the fact that the swash plate of the above construction is easy in production.

DETAILED DESCRIPTION OF THE INVENTION

Figure 1:
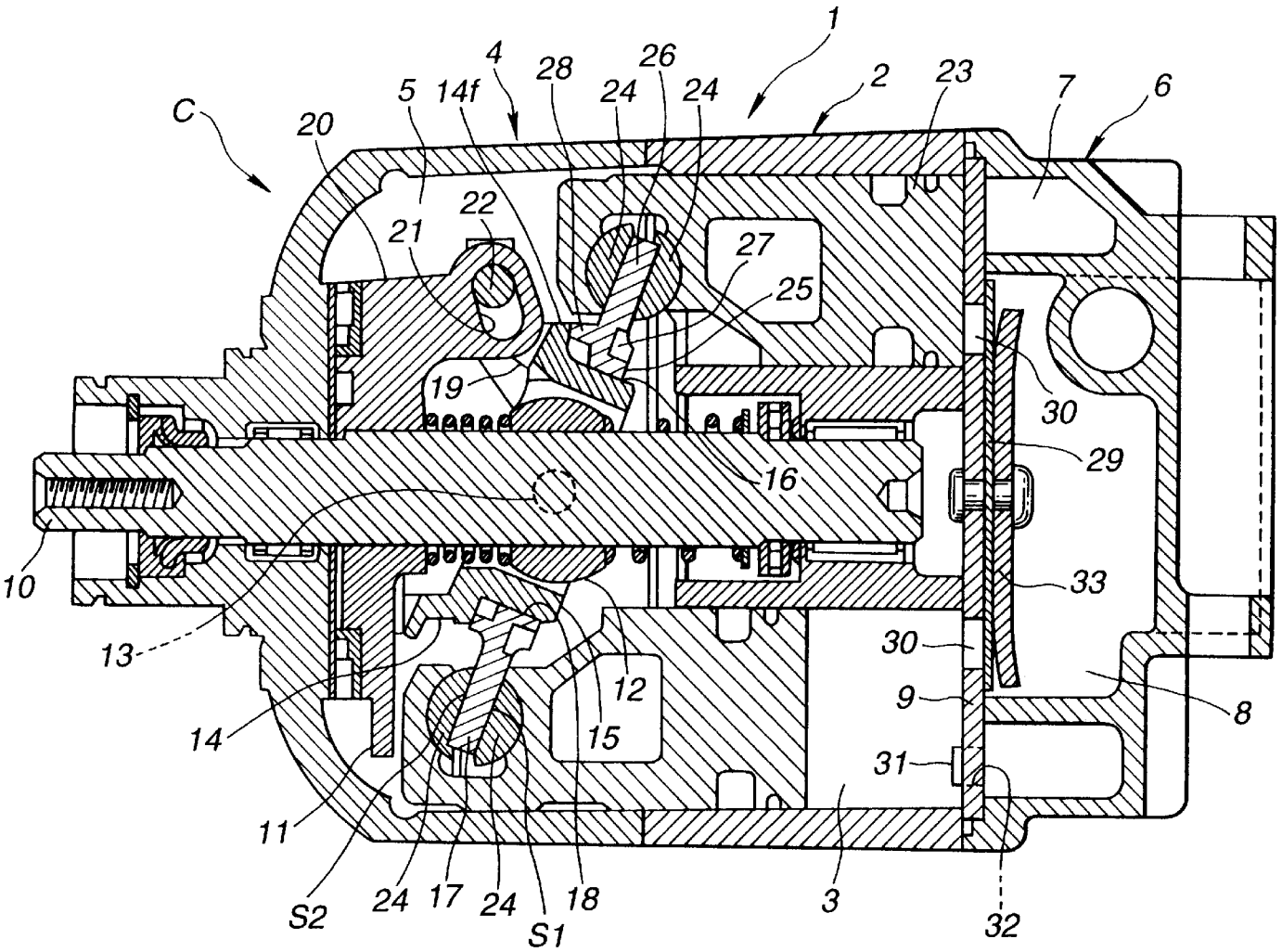
FIG. 1 is a vertical sectional view of an embodiment of a swash plate type variable displacement compressor according to the present invention.
Figure 2:
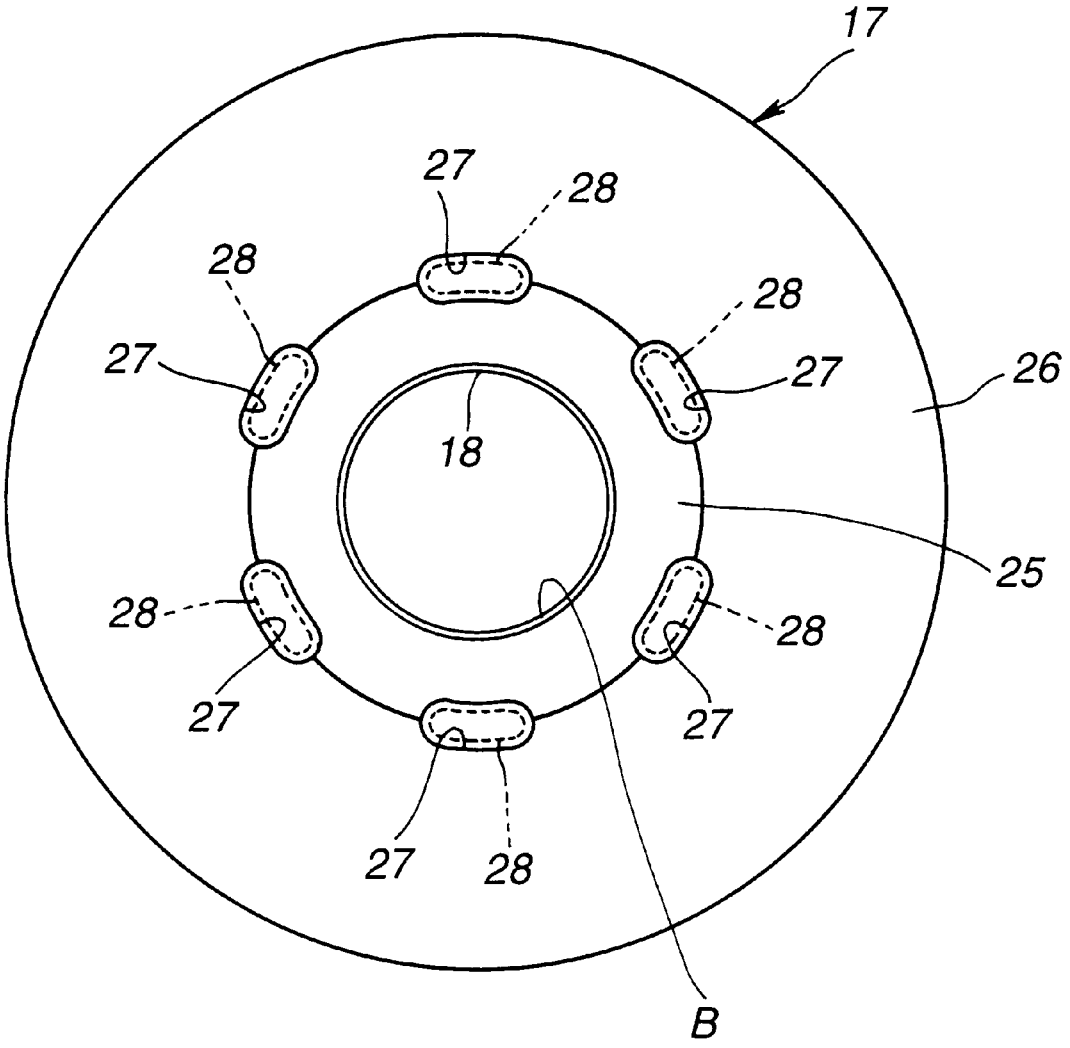
FIG. 2 is a side view of a swash plate used in the compressor of FIG. 1.

Referring now to FIGS. 1 and 2, a first embodiment of a swash plate type variable displacement compressor according to the present invention is illustrated by the reference character C. The swash type variable displacement compressor C of this embodiment is used for pressurizing refrigerant in an air conditioning system (not shown) of an automotive vehicle. The compressor C comprises a compressor housing 1 which includes a cylinder block 2. The cylinder block 2 is formed with a plurality of cylinder bores 3. A front housing 4 is disposed in front of the cylinder block 2 and fixedly connected to the cylinder block 2 to define thereinside a crank chamber 5. A rear housing 6 is disposed behind the cylinder block 2 and fixedly connected to the cylinder block 2 through a valve plate 9. The rear housing 6 is formed with a refrigerant suction chamber 7 and a refrigerant discharge chamber 8. The refrigerant discharge chamber 8 is located at the diametrically central section of the rear housing 6, while the refrigerant suction chamber 7 is located at the diametrically outer peripheral section of the rear housing 6.

A drive shaft 10 is disposed to axially extend through the front housing 4 and the cylinder block 3. A drive plate 11 is fixedly mounted on the drive shaft 10 and located in the crank chamber 5. A sleeve 12 is slidably mounted on the drive shaft 10. A journal 14 is swingably connected through pins 13 to the sleeve 12. The journal 14 has a boss section 15 which is formed at its outer peripheral surface with an external thread portion 16. A generally annular disc-shaped swash plate 17 is fixedly and coaxially mounted on the boss section 15 of the journal 14 in such a manner that an internal thread 18 of the swash plate 17 is engaged with the external thread portion 16 of the journal 14. The journal 14 has a hinge arm 19 which is movably connected to a hinge arm 20 of the drive plate 11 in such a manner that a pin 22 of the hinge arm 19 is slidably disposed within an elongate hole 21 of the hinge arm 20, so that swingable movement of the journal 14 is restricted under the action of the elongate hole 21.

A piston 23 is movably disposed inside each cylinder bore 3. Each piston 23 is connected to the swash plate 17 through a pair of shoes 24 which are located respectively on the opposite sides of swash plate 17. The swash plate 17 is inclinable relative to an imaginary plane (not shown) to which the axis of the drive shaft 10 is perpendicular, thereby forming an inclination angle. The inclination angle of the swash plate 17 is changed by a pressure within the crank chamber 5 which pressure is adjusted in accordance with a pressure within the refrigerant suction chamber 7 under the action of a pressure control valve mechanism (not shown). Such change in inclination angle of the swash plate 17 changes the stroke of each piston 23 thereby altering the amount of refrigerant discharged from the compressor C.

The valve plate 9 is formed with discharge holes 30 and suction holes 32 through which refrigerant flows in and out of the cylinder bores 3. The discharge holes 30 are closable with a lead valve 29. The lead valve 29 is restricted in its movement by a retainer 33. The suction holes 32 are closable with lead valves 31.

The basic construction and operation of the swash plate type compressor C are known as disclosed in U.S. Pat. No. 5,706,716 entitled "Variable Displacement Swash Plate Type Compressor", and U.S. Pat. No. 5,749,712 entitled "Variable Displacement Swash Plate Type Compressor" which are hereby incorporated by reference.

In this embodiment, the swash plate 17 includes a generally cylindrical central section 25 which is formed relatively thick and is formed at its inner peripheral surface with the internal thread 18 defining the central bore B (identified in FIG. 2). A generally flat annular disc or peripheral section 26 is formed integral with the central section 26 to extend radially outward of the central section 26 in such a manner that the axis of the central section 26 is perpendicular to the flat disc section 26. The opposite surfaces of the disc section 26 serve as shoe-sliding surfaces to which the shoes 24, 24 are slidingly contactable.

The thick central section 25 is formed at its rear side surface S1 of the swash plate 17 with a plurality of tool engaging grooves 27 which are arranged in the same circumference concentric with the central bore B defined by the internal thread portion 18. These tool engaging grooves 27 are formed by so-called fine or half blanking (process) applied onto the rear side surface S1 of the swash plate 17. The fine blanking includes pressing or embossing applied onto the rear side surface S1 of the swash plate 17. As a result of the fine blanking, a plurality of seat projections 28 are formed projecting at the front side surface S2 (opposite to the rear side surface S1) of the thick central section 26. The seat projections 28 are located corresponding respectively to the tool engaging grooves 27. It will be understood that each seat projection 28 is formed projecting forward or in a direction away from the front side surface S2 by forming the corresponding tool engaging groove 27 which is formed by depressing a portion of the rear side surface S1 under the fine blanking. Each seat projection section 28 is to be in contact with a flange section **14*f* of the journal 14**.

Thus, each seat projection section 28 is formed at the back side surface of the corresponding tool engaging groove 27 under the fine blanking, and therefore it is sufficient that the thick central section 25 is formed projecting only rearward or in a direction away from the rear side surface S1 by an amount to form the internal thread portion 18, without projecting forward or in the direction away from the front side surface S2.

It is preferable that the number of the tool engaging grooves 27 is two times of that of engagement claw portions of a tightening tool (not shown) for tightening the swash plate 17. In this embodiment, six tool engaging grooves 27 are formed corresponding to three engagement claw portions of the tightening tool. The tool engaging grooves 27 are formed at equal intervals. Additionally, each engaging groove 27 is formed as an arcuate elongate groove so that the engagement claw portion can be easily engaged with the engaging groove 27. As shown in FIG. 2, each engagement groove 27 formed extending over both the central section 25 and the disc section 26.

Advantageous effects of the above-arranged compressor C will be discussed hereafter.

The tool engaging grooves 27 on one side surface and the seat projections 28 on the other side surface in the swash plate 17 can be easily formed respectively as depressions and projections by applying the fine blanking onto the thick central section 25. Additionally, each seat projection 28 is formed just at the back side surface of the tool engaging groove 27 simultaneously with depressed-formation of the corresponding tool engaging groove 27 under the fine blanking, and therefore it is required to only protrude one end portion (on the side of the rear side surface S1) of the thick central section 25 so that protruding the opposite end portion (on the side of the front side surface S2) is unnecessary. Consequently, the thick central section 25 is only required to have a necessary minimum thickness (axial dimension) to ensure a dimension for forming the internal thread portion 18.

As a result, the swash plate 17 can be sharply lightened in weight thereby greatly contributing to making the compressor C light in weight. This is very advantageous from the viewpoint of production cost upon combination of the fact that the swash plate 17 of the above construction is easy in production.

Furthermore, in this embodiment, each of the tool engaging grooves 27 is formed extending over both the central section 25 and the disc section 26. Consequently, the tool engaging grooves 27 serve as oil sinks in which oil contained in refrigerant in the state of mist can be caught and stored. As a result, effective oil supply to a slidingly contacting section between the disc section 26 and the shoes 24 can be made from the oil sinks 27 thereby improving lubricating ability for the slidingly contacting section. Particularly, even when the compressor C is started after a long time stoppage, oil can be smoothly supplied to the slidingly contacting section between the disc section 26 and the shoes 24.

What is claimed is:

1. A swash plate type variable displacement compressor comprising:

a drive shaft;

a journal movably disposed around said drive shaft so as to be rotatable with said drive shaft, said journal having a generally cylindrical boss section which has an external thread portion, and a flange section;

pistons movably arranged around said journal; and a swash plate for converting a rotational motion of said drive shaft into a linear motion of said pistons, said swash plate being fixedly mounted on said boss section of said journal and having an internal thread portion which is engaged with the external thread portion of said boss section, said swash plate including a generally cylindrical thick central section having the internal thread portion, a peripheral section integral with said central section and having an axial dimension smaller than said central section, a plurality of tool engaging grooves formed at least in said central section and located on a first surface of said swash plate, said tool engaging grooves being located along a circumference concentric with a central bore of said central section, and a plurality of seat projections formed on a second surface of said swash plate which second surface is opposite to the first surface, each seat projection projecting in a direction away from the second surface, said seat projections being located respectively corresponding to and at back sides of said tool engaging grooves, each seat projection being to be in contact with the flange section of said journal.

2. A swash plate type variable displacement compressor as claimed in claim 1, wherein each seat projection is formed projecting simultaneously with formation of the corresponding tool engaging groove by a pressing action for forming the corresponding tool engaging groove.

3. A swash plate type variable displacement compressor as claimed in claim 1, wherein said seat projections are formed simultaneously with said tool engaging grooves under fine blanking process in which each seat projection is formed projecting simultaneously with formation of the corresponding tool engaging groove.

4. A swash plate type variable displacement compressor as claimed in claim 1, wherein each tool engaging groove is formed at an outer peripheral portion of said central section and formed extending over said central section and said peripheral section.

5. A swash plate type variable displacement compressor as claimed in claim 1, wherein said central section of said swash plate projects only in a direction away from the first surface of said swash plate without being projecting in a direction away from the second surface of said swash plate.

* * * * *